US007543860B2

(12) United States Patent
Meeks et al.

(10) Patent No.: US 7,543,860 B2
(45) Date of Patent: Jun. 9, 2009

(54) SLIDE BOLT ASSEMBLY FOR AN ASTRAGAL

(75) Inventors: James W. Meeks, Eaton, OH (US); Michael E. Pepper, Richmond, IN (US); Brian S. Hewitt, Eaton, OH (US)

(73) Assignee: Quanex Corporation, Houston, TX (US)

( * ) Notice: Subject to any disclaimer, the term of this patent is extended or adjusted under 35 U.S.C. 154(b) by 9 days.

(21) Appl. No.: 11/327,056

(22) Filed: Jan. 6, 2006

(65) Prior Publication Data

US 2006/0150517 A1 Jul. 13, 2006

Related U.S. Application Data

(60) Provisional application No. 60/642,447, filed on Jan. 7, 2005.

(51) Int. Cl.
*E05C 1/02* (2006.01)

(52) U.S. Cl. ..... 292/137; 292/DIG. 15; 292/DIG. 21

(58) Field of Classification Search ..... 292/137, 292/138, 146, DIG. 15 X, DIG. 21 X
See application file for complete search history.

(56) References Cited

U.S. PATENT DOCUMENTS

| | | | | |
|---|---|---|---|---|
| 137,211 | A | 3/1873 | Jones | |
| 3,378,290 | A * | 4/1968 | Sekulich | 292/40 |
| 3,649,060 | A * | 3/1972 | Ruff | 292/42 |
| 3,806,175 | A | 4/1974 | Van Herpen | |
| 3,888,046 | A * | 6/1975 | Meisterheim | 49/319 |
| 3,944,266 | A | 3/1976 | Weaver | |
| 4,052,819 | A | 10/1977 | Beischel et al. | |
| 4,058,332 | A | 11/1977 | DiFazio | |
| 4,429,493 | A | 2/1984 | St. Aubin | |
| 4,625,457 | A | 12/1986 | Avery | |
| 5,328,217 | A | 7/1994 | Sanders | |
| 5,350,207 | A | 9/1994 | Sanders | |
| 5,590,919 | A | 1/1997 | Germano | |
| 5,857,291 | A | 1/1999 | Headrick | |
| 6,457,751 | B1 * | 10/2002 | Hartman | 292/137 |
| 6,491,326 | B1 | 12/2002 | Massey et al. | |
| 6,666,486 | B1 | 12/2003 | Fleming | |

(Continued)

OTHER PUBLICATIONS

U.S. Patent Application Title "Astragal Boot", U.S. Appl. No. 11/244,786, filed Oct. 6, 2005; 18 pages.

*Primary Examiner*—Patricia Engle
*Assistant Examiner*—Mark Williams
(74) *Attorney, Agent, or Firm*—Howard & Howard Attorneys PLLC

(57) ABSTRACT

A slide bolt assembly is slideably engaged in an astragal disposed at a free end of a semi-active door in a double-door set. The slide bolt assembly includes an elongated base that slideably engages the astragal. The slide bolt assembly defines a threaded hole and a screw lock is rotatably disposed in the threaded hole between an unlocked position and a locked position to lock the elongated base within the astragal. The screw lock defines a central portion and a rim portion peripherally surrounding the central portion. The rim portion presents a contact surface that is planar. A nipple protrudes from the central portion further than the rim portion. When the screw lock is rotated to the locked position, the nipple pierces a wall of the astragal and the contact surface of the rim portion frictionally engages the wall to lock the slide bolt assembly within the astragal at any point along the astragal.

32 Claims, 7 Drawing Sheets

U.S. PATENT DOCUMENTS

| | | | | |
|---|---|---|---|---|
| 6,905,152 | B1 * | 6/2005 | Hudson | 292/143 |
| 7,213,299 | B2 * | 5/2007 | Grande | 16/66 |
| 2003/0052492 | A1 | 3/2003 | Massey et al. | |
| 2004/0256858 | A1 | 12/2004 | Governale et al. | |
| 2005/0116424 | A1 | 6/2005 | Sanders | |
| 2005/0120630 | A1 | 6/2005 | Sanders | |
| 2005/0120631 | A1 | 6/2005 | Sanders | |
| 2005/0193784 | A1 | 9/2005 | Sanders | |

* cited by examiner

FIG - 3A
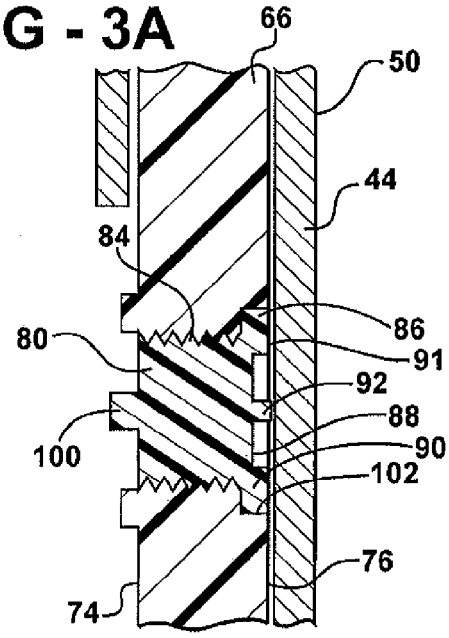
FIG - 3B
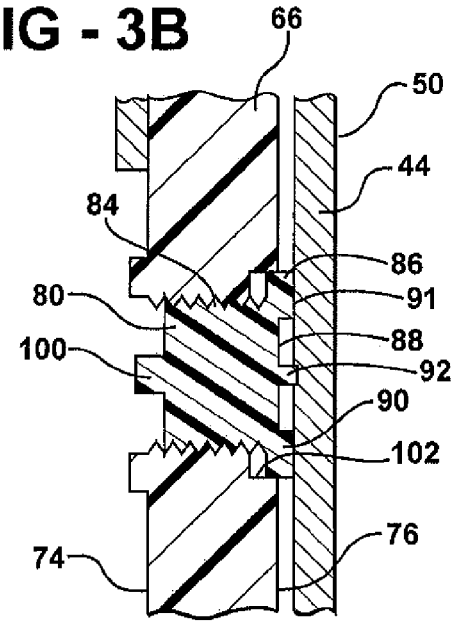
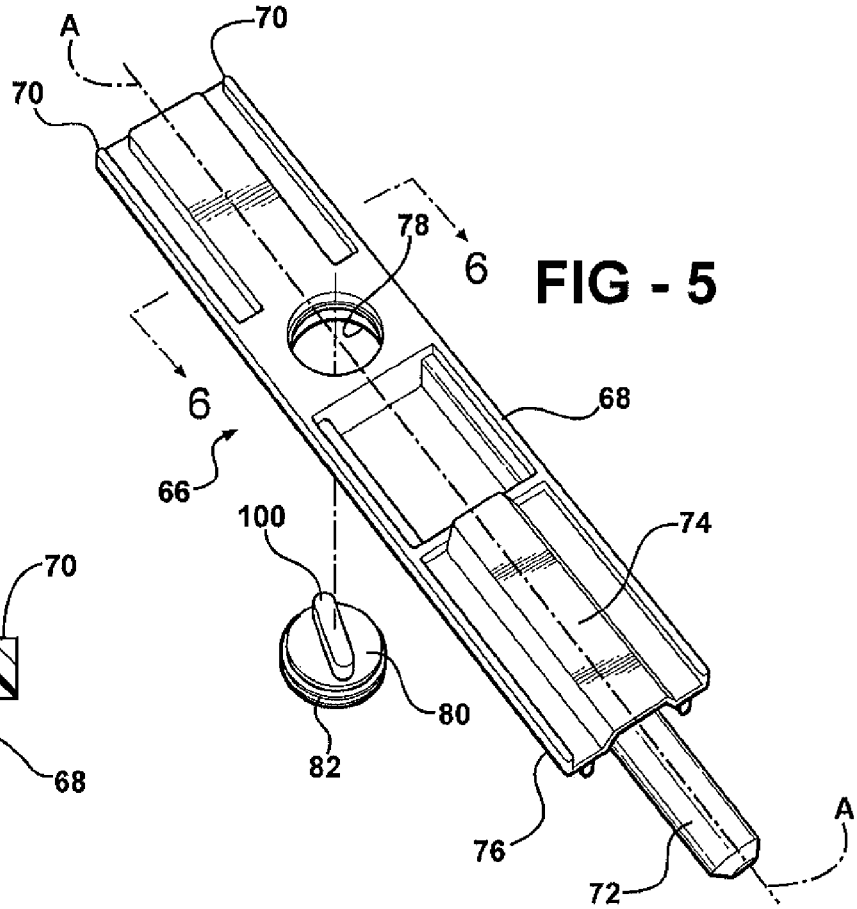
FIG - 5
FIG - 6
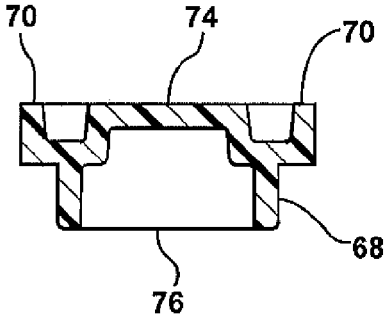

SLIDE BOLT ASSEMBLY FOR AN ASTRAGAL

CROSS REFERENCE TO RELATED APPLICATION

This application claims the benefit of U.S. Provisional Patent Application Ser. No. 60/642,447 filed Jan. 7, 2005.

BACKGROUND OF THE INVENTION

1. Field of the Invention

The invention generally relates to an astragal assembly for disposition on a free end of a semi-active door in a double-door set. Specifically, the invention relates to an astragal assembly including an astragal and a slide bolt assembly for sliding between a retracted position and an extended position within the astragal.

2. Description of the Related Art

Various astragal assemblies are known in the art to include an astragal and a slide bolt assembly for sliding between a retracted position and an extended position within the astragal. The astragal assembly is disposed between an active door and a semi-active door of a double-door set. The double-door set is disposed over a threshold in a door opening of a building. Typically, the astragal is mounted onto a free end of a semi-active door such that the astragal moves with the free end as the semi-active door swings between an open position and a closed position. When the semi-active door is in the closed position, the slide bolt assembly slides within the astragal to the extended position to engage the threshold to lock the semi-active door in the closed position.

Typically, the slide bolt assembly includes an elongated base slideably engaged within the astragal. A bolt generally extends from the elongated base and the bolt engages the threshold when the slide bolt assembly is in the extended position. Specifically, when the slide bolt assembly is in the retracted position, the bolt is retracted within the astragal and the semi-active door is swingable between an open position and a closed position. When the semi-active door is in the closed position, the slide bolt assembly is slid within the astragal to the extended position such that the bolt extends from the astragal and engages the threshold to lock the semi-active door in the closed position.

Typically, the slide bolt assembly includes a lock to lock the slide bolt assembly within the astragal. Specifically, U.S. Pat. No. 6,457,751 to Hartman (the '751 patent) discloses a slide bolt assembly including a cylindrical lock rotatable to a locked position to lock the slide bolt assembly in the extended position whereby a length of a bolt engages a keeper in an underlying threshold. The '751 patent is deficient because if the height of the astragal is raised, or if dirt and/or debris becomes lodged in the keeper, the slide bolt assembly is prevented from fully extending to the extended position thereby preventing the cylindrical lock from being rotated to a locked position. Specifically, the slide bolt assembly defines a hole and the cylindrical lock is rotatably disposed in the hole for rotation between a locked position and an unlocked position. Specifically, the lock defines a channel and the astragal assembly presents a post. The post is stationary along the astragal so that the slide bolt assembly is slideable relative to the post. In the unlocked position, the channel is aligned with the post such that the post travels through the channel thereby allowing the slide bolt assembly to slide between the retracted and extended positions. In the locked position, the channel is misaligned with the post such that the post may not travel through the channel. When the slide bolt assembly is in the extended position, the cylindrical lock is rotatable to the locked position to locking the slide bolt assembly in the extended position. Because the post is stationary, the slide bolt assembly is only lockable in one extended position. In other words, the length of the bolt extending from the astragal when the screw lock is in the locked position is not adjustable. Therefore, if the height of the threshold is varied, or if dirt and/or debris become lodged in the keeper of the threshold, the slide bolt assembly cannot fully extend to the extended position. In other words, dirt and/or debris will prevent the bolt from fully extending from the astragal thereby preventing the post from sliding completely through the channel. The lock will thereby be blocked by the post and will not be rotatable to the locked position.

U.S. Pat. No. 3,944,266 to Weaver (the '266 patent) also discloses a slide bolt assembly for a sliding door. A U-shaped channel is attached to the sliding door and the slide bolt assembly is slideably engaged in the U-shaped channel for sliding between a retracted position and an extended position. The slide bolt assembly includes a bolt that engages a door frame when the slide bolt assembly is in the extended position. The slide bolt assembly includes an elongated base slideably engaged in the U-shaped channel. The elongated base defines a threaded hole. A screw lock is threadingly engaged with the threaded hole. The screw lock rotatable between an unlocked position and a locked position. The screw lock has a flat end and in the locked position, the flat end frictionally engages the door to prevent the slide bolt assembly from sliding within the U-shaped channel. The screw lock of the '266 patent is deficient because, in the locked position, if a force is applied to the screw lock, the flat end of the screw lock slips along the door thereby allowing the slide bolt assembly to slide relative to the door.

Therefore, in view of the deficiencies associated with the prior art outlined above, it is desirable to manufacture an astragal assembly including a slide bolt assembly that may rotated to the locked position at any point along the astragal that the slide bolt assembly is slid to accommodate for variation in the height of the underlying threshold or dirt and/or debris that may become lodged in the keeper of the threshold. In addition, it is desirable to manufacture an adjustable slide bolt assembly that does not slip relative to the astragal when the screw lock is in the locked position.

SUMMARY OF THE INVENTION AND ADVANTAGES

The present invention is a slide bolt assembly for sliding between a retracted position and an extended position within an astragal disposed at a free end of a semi-active door in a double-door set to releasably lock the semi-active door in a closed position. The slide bolt assembly includes an elongated base extending along an axis for slideably engaging the astragal generally parallel with the axis between the retracted position and the extended position. The elongated base defines a threaded hole extending generally perpendicular to the axis. A screw lock presents a central portion and a rim portion peripherally surrounding the central portion. The screw lock threadingly engages the threaded hole of the elongated base for rotation between an unlocked position and a locked position to lock the elongated base within the astragal. A nipple protrudes from the central portion of the screw lock and extends further from the screw lock than the rim portion for piercing a wall of the astragal when the screw lock is rotated to the locked position.

Accordingly, the screw lock may be rotated to the locked position at any point along the astragal that the slide bolt assembly is slid. Thus, the astragal assembly is more versatile because the screw lock may be locked in any position along the astragal to accommodate for variation in the height of an underlying threshold or to accommodate for dirt and/or debris that becomes lodged in a keeper of the astragal. Additionally, because the nipple extends further from the central portion than does the rim portion, when in the locked position, the nipple pierces the wall of the astragal to prevent the sliding of the slide bolt assembly within the astragal. The rim portion of the screw lock also provides frictional engagement with the wall of the astragal to prevent the sliding of the slide bolt assembly within the astragal when the screw lock is in the locked position. Thus, the astragal assembly is more versatile because the slide bolt assembly is securely lockable in the extended position. The slide bolt assembly is also easy to manufacture and cost effective.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 3A is a cross-sectional side view of a portion of the astragal assembly taken along line 3-3 of FIG. 2 with a screw lock in the unlocked position;

FIG. 3B is a cross-sectional side view of a portion of the astragal assembly taken along the line 3-3 of FIG. 2 with the screw lock in the locked position;

FIG. 5 is an exploded view of the slide bolt assembly including an elongated base and the screw lock;

FIG. 6 is a cross-sectional view of the elongated base taken along line 6-6 of FIG. 5;

DETAILED DESCRIPTION OF THE INVENTION

Figure 1:
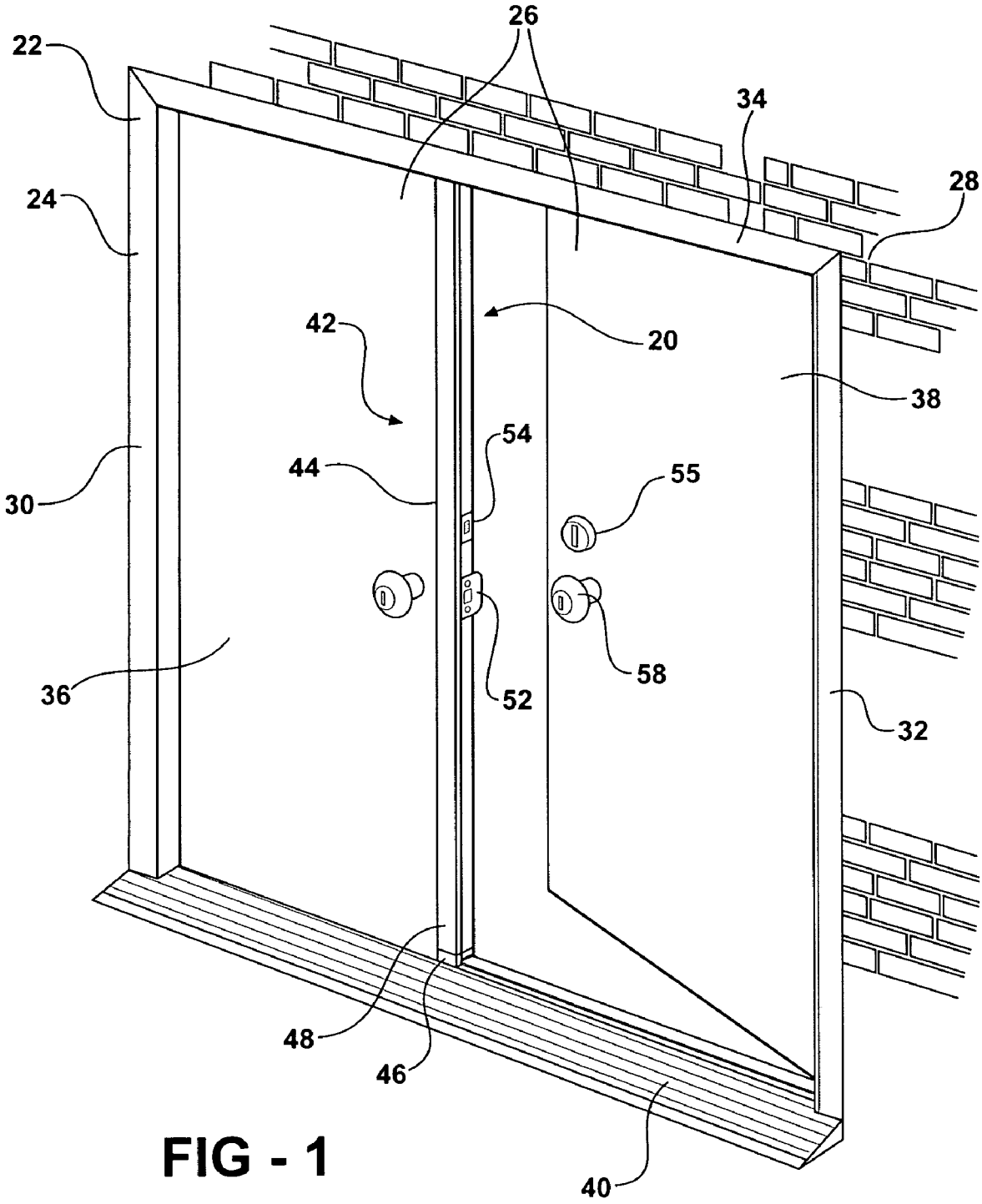
FIG. 1 is a perspective view of an astragal assembly disposed in a door assembly.

Referring to the Figures, wherein like numerals indicate corresponding parts throughout the several views, an astragal assembly is generally shown at 20. As shown in FIG. 1, the astragal assembly 20 is mounted in a door assembly 22. The door assembly 22 includes a frame 24 and a double-door set 26 mounted to the frame 24. More specifically, the frame 24 is mounted in a door opening of a building 28 such as a commercial or a residential building 28. The frame 24 includes a first vertical member 30, a second vertical member 32 spaced from and in parallel with the first vertical member 30, and a header 34 extending between the first vertical member 30 and the second vertical member 32. The double-door set 26 includes a semi-active door 36 rotatably mounted to the first vertical member 30 of the frame 24 and an active door 38 rotatably mounted to the second vertical member 32 of the frame 24. The semi-active door 36 and the active door 38 rotate relative to the first vertical member 30 and the second vertical member 32, respectively, such that the doors 36, 38 may independently swing between an open position and a closed position. A threshold 40 is mounted in the door opening of the building 28 below the door assembly 22 such that the threshold 40 extends between the first vertical member 30 and the second vertical member 32 of the frame 24.

As shown in FIG. 1, the astragal assembly 20 is disposed on a free end 42 of the semi-active door 36 in the double-door set 26. The astragal assembly 20 includes an astragal 44 disposed on the free end 42 of the semi-active door 36 in the double-door set 26. It should be appreciated that one skilled in the art may also refer to the astragal 44 as a profile. The astragal assembly 20 preferably includes an astragal boot 46 for mounting onto a lower end 48 of the astragal 44. The astragal boot 46 is preferably the type described in the U.S. patent application Ser. No. 11/244,786 to Pepper et al., which is hereby incorporated by reference. The astragal assembly 20 extends between the active door 38 and the semi-active door 36 from the threshold 40 to the header 34 when the doors 36, 38 are in the closed position. More specifically, the astragal boot 46 seals against the threshold 40 and the astragal 44 extends upwardly between the doors 36, 38 from the astragal boot 46 to the header 34.

The astragal 44 defines a wall 50. The astragal 44 is attached to the semi-active door 36 such that the astragal 44 moves with the free end 42 of the semi-active door 36 when the semi-active door 36 is swung between the open position and the closed position.

As shown in FIG. 1, the astragal assembly 20 preferably includes a latch strike plate 52 and a deadbolt strike plate 54 mounted on a first inside surface 56 of the astragal 44. The latch strike plate 52 is aligned along the first inside surface 56 to receive a latch from a door knob assembly 58 on the active door 38 when the active door 38 and the semi-active door 36 are in the closed position. When both the active door 38 and the semi-active door 36 are in the closed position, the latch from the door knob assembly 58 engages the latch strike plate 52 on the semi-active door 36 to engage the active door 38 to the semi-active door 36. A door knob on the door knob assembly 58 may be turned to disengage the latch from the latch strike plate 52 thereby disengaging the active door 38 from the semi-active door 36. Likewise, the deadbolt strike plate 54 is aligned along the first inside surface 56 to receive a deadbolt from a deadbolt assembly 55 on the active door 38 when the active door 38 and the semi-active door 36 are in the closed position.

Figure 2:
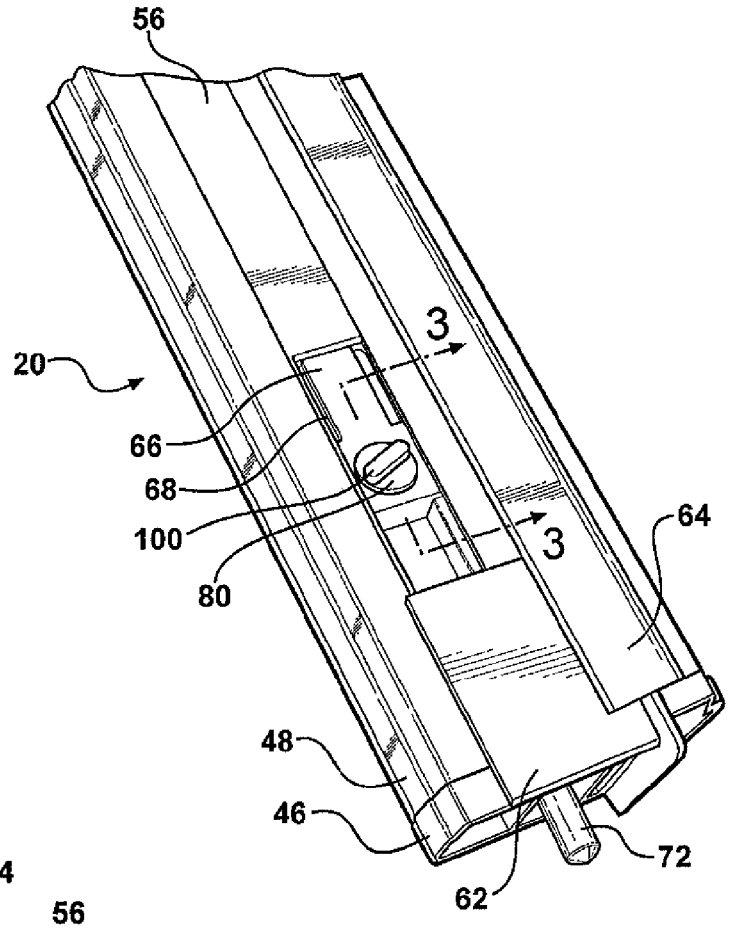
FIG. 2 is a perspective view of the astragal assembly.
Figure 4A:
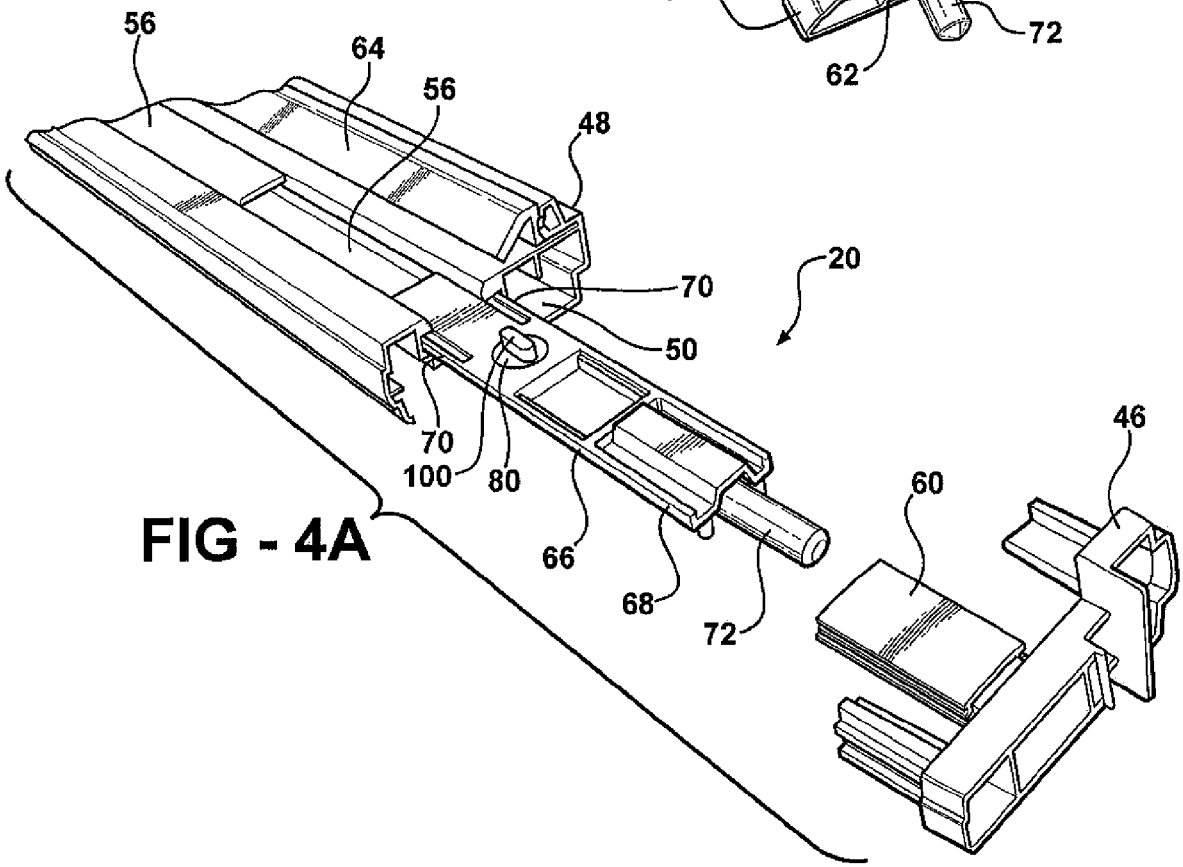
FIG. 4A is a partially exploded view of the astragal assembly.
Figure 4B:
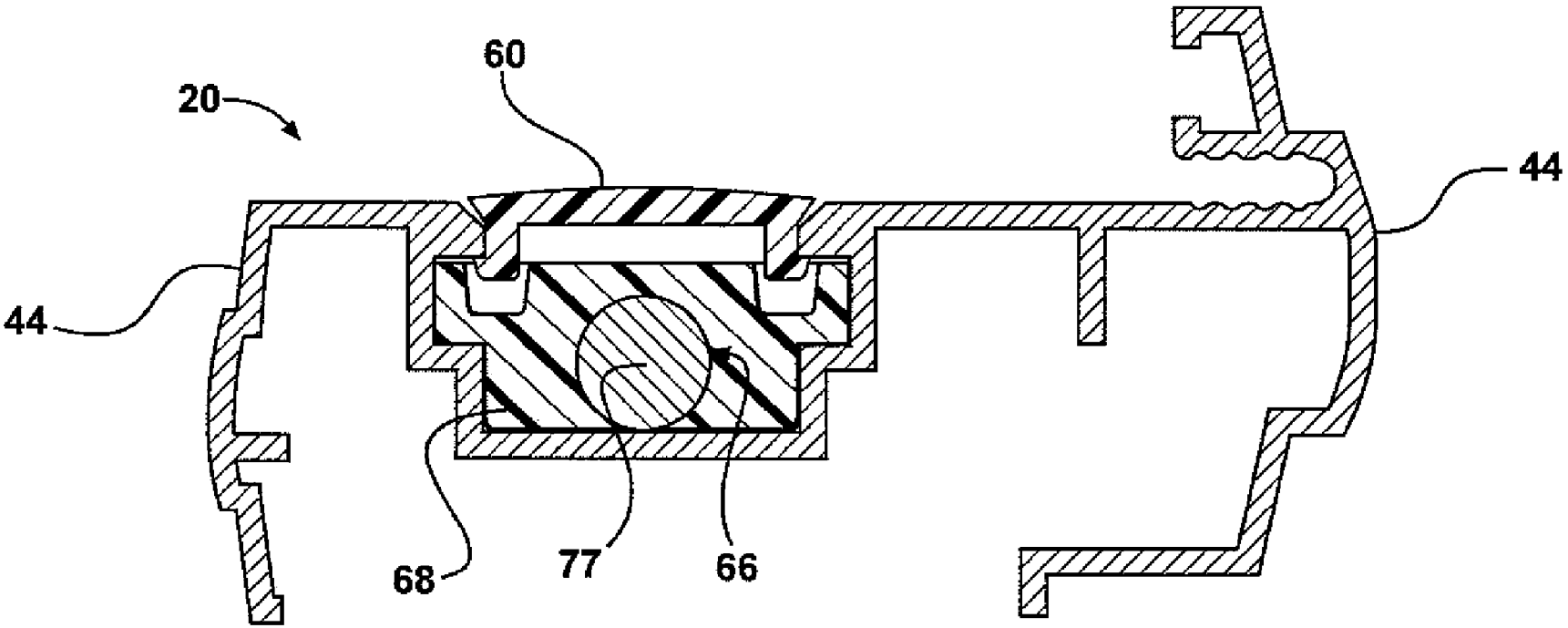
FIG. 4B is a partial cross-sectional end view of a slide bolt assembly within the astragal.

As shown in FIGS. 4A and 4B, the astragal assembly 20 preferably includes an end cover 60 inserted into the lower end 48 of the astragal 44 when the astragal boot 46 is attached to the astragal 44. As shown in FIG. 2, a corner pad 62 is preferably attached to the first inside surface 56 of the astragal 44, to the end cover 60, and to the astragal boot 46. The corner pad 62 is not shown in FIGS. 4A and 4B, and the end cover 60 is disposed below the corner pad 62 in FIG. 2. The corner pad 62 contacts the threshold 40 when the semi-active door 36 is in the closed position to seal against the threshold 40. A weather seal 64 extends along a second inside surface of the astragal 44 and extends over the corner pad 62. Preferably, an end user, such as an installer, attaches the corner pad 62 to the astragal 44, to the end cover 60, and to the astragal boot 46. More specifically, double-sided tape or an adhesive is disposed on the corner pad 62 and a backing may be disposed on the double-sided tape or adhesive. The end user removes the backing, flips the weather seal 64 over the corner pad 62, and applies pressure to the corner pad 62 to adhere the corner pad 62 to the astragal 44, to the end cover 60, and to the astragal boot 46. When the semi-active door 36 and the active door 38 are in the closed position, the corner pad 62 and the weather seal 64 prevent the elements, i.e. water, draft, and debris, from penetrating between the active door 38 and the astragal 44.

As shown in FIGS. 2-6, the astragal assembly 20 includes a slide bolt assembly 66 which may slide within the astragal 44 disposed at the free end 42 of the semi-active door 36 in the double door set 26. FIG. 4B more specifically illustrates disposition of the slide bolt assembly 66 within the astragal 44 and also the physical relationship of the end cover 60 in relation to the astragal 44 and the slide bolt assembly 66.

The slide bolt assembly 66 includes an elongated base 68. The elongated base 68 may be formed from any rigid material or combination of rigid materials and is preferably formed from plastic. The elongated base 68 extends along an axis A-A and slideably engages the astragal 44 generally parallel with the axis A-A between a retracted position and an extended position. The axis A-A is shown in FIG. 5. Specifically, the elongated base 68 presents a pair of lateral rails 70 opposed and extending generally parallel with the axis A-A for slideably engaging the wall 50 of the astragal 44 to slide the slide bolt assembly 66 within the astragal 44 between the retracted position and the extended position.

As shown in FIGS. 2, 4, and 5, a bolt 72 extends from the elongated base 68 generally parallel with the axis A-A. The bolt 72 is be integral with or an attachment to the elongated base 68. The bolt 72 is be formed from any type of rigid material, preferably metal, and more preferably steel.

The slide bolt assembly 66 is slideable along the astragal 44 to the extended position to engage the underlying threshold 40. As shown in FIG. 2, the astragal boot 46 defines an orifice and when the slide bolt assembly 66 is in the extended position, the bolt 72 extends through the orifice. When the semi-active door 36 is in the closed position, the slide bolt assembly 66 may be slideable to the extended position to engage a keeper in the threshold 40. The semi-active door 36 does not rotate relative to the threshold 40 when the slide bolt assembly 66 is slid to the extended position and engaged with the underlying threshold 40. The semi-active door 36 is rotatable relative to the frame 24 of the door assembly 22 when the slide bolt assembly 66 is in the retracted position.

As shown in FIG. 6, the elongated base 68 presents a face 74 and a back 76 opposite the face 74. The lateral rails 70 are defined in the face 74. As shown in FIG. 4, when the slide bolt assembly 66 is disposed within the astragal 44, the face 74 is disposed facing an opening of the astragal 44 and the back 76 is disposed facing the wall 50 of the astragal 44.

As shown in FIGS. 2, 3A, 3B, and, the elongated base 68 defines a threaded hole 78 extending generally perpendicular to the axis A-A. Specifically, the threaded hole 78 of the elongated base 68 is defined through the back 76 and the face 74 of the elongated base 68.

Figure 9A:
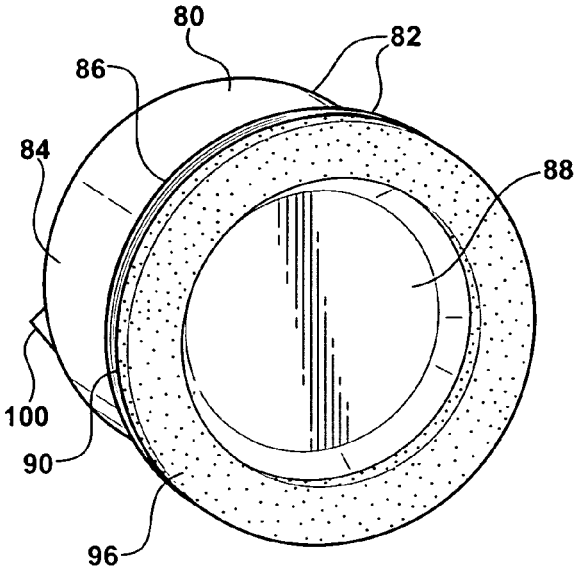
FIG. 9A is a front perspective view of a third embodiment of the screw lock.
Figure 9B:
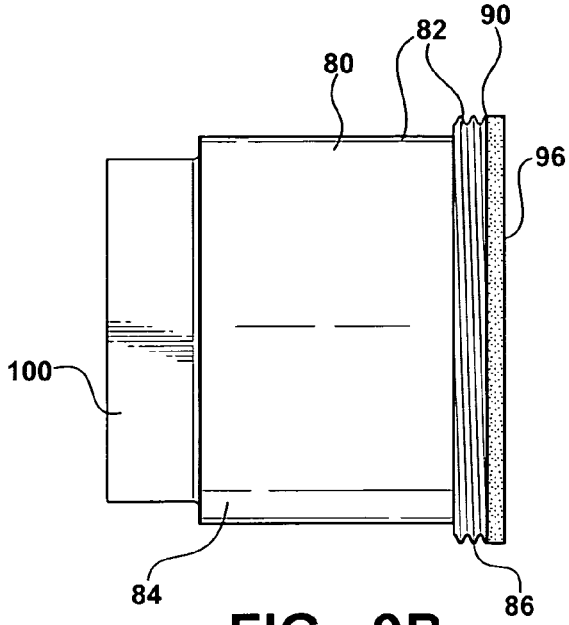
FIG. 9B is a side view of the third embodiment of the screw lock.
Figure 10A:
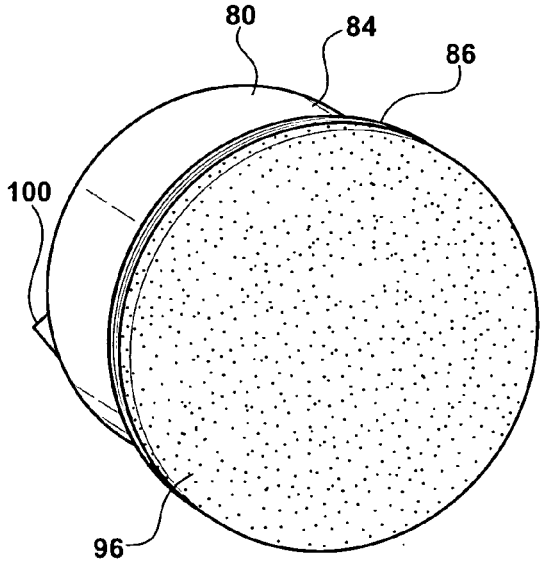
FIG. 10A is a front perspective view of a fourth embodiment of the screw lock.
Figure 10B:
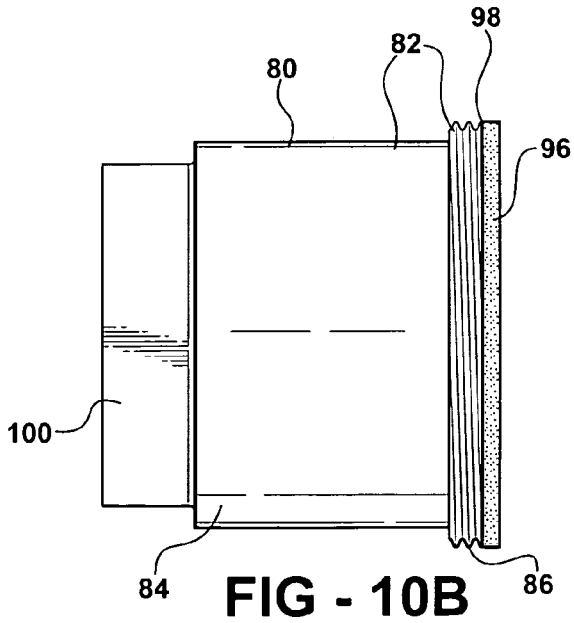
FIG. 10B is a side view of the fourth embodiment of the screw lock.

As shown in FIGS. 2-5, the slide bolt assembly 66 includes a screw lock 80 threadingly engaging the threaded hole 78. Several embodiments of the screw lock 80 are shown in FIGS. 7A-10B. Specifically, a first embodiment of the screw lock 80 is shown in FIGS. 3A-B and FIGS. 7A-C, a second embodiment of the screw lock 80 is shown in FIGS. 8A-C, a third embodiment of the screw lock 80 is shown in FIGS. 9A-B, and a fourth embodiment of the screw lock 80 is shown in FIGS. 10A-B.

Because the screw lock 80 engages the wall 50 of the astragal 44, the screw lock 80 may be rotated to the locked position at any point along the astragal 44 that the slide bolt assembly 66 is slid. Therefore, the slide bolt assembly 66 accommodates for variation in the height of the underlying threshold 40 or dirt and/or debris that may become lodged in the keeper of the threshold 40. In other words, if dirt and/or debris in the keeper prevents the bolt 72 from extending fully to the extended position, the bolt 72 may be extended as far as possible into the keeper and the screw lock 80 may be rotated to the locked position. Likewise, if the height of the threshold 40 is changed, the bolt 72 may be extended as far as possible into the keeper and the screw lock 80 may be rotated to the locked position.

Figure 7A:
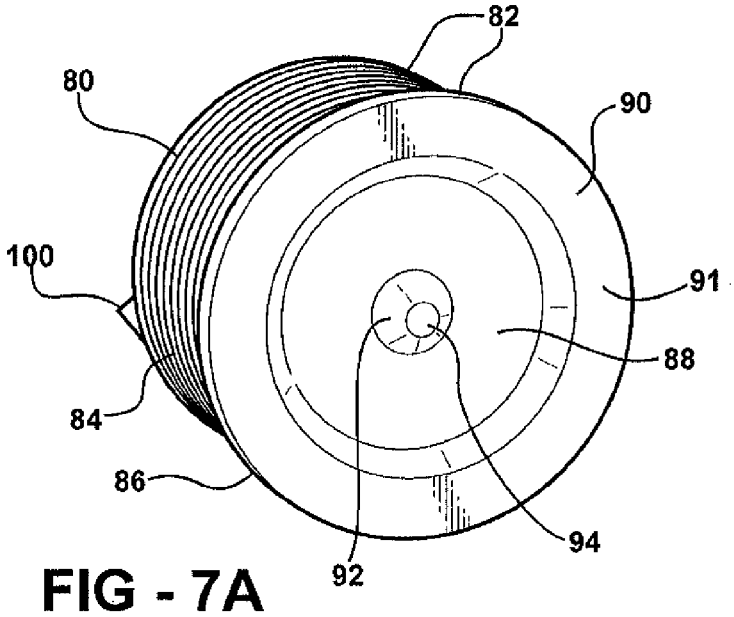
FIG. 7A is a front perspective view of a first embodiment of the screw lock.
Figure 7B:
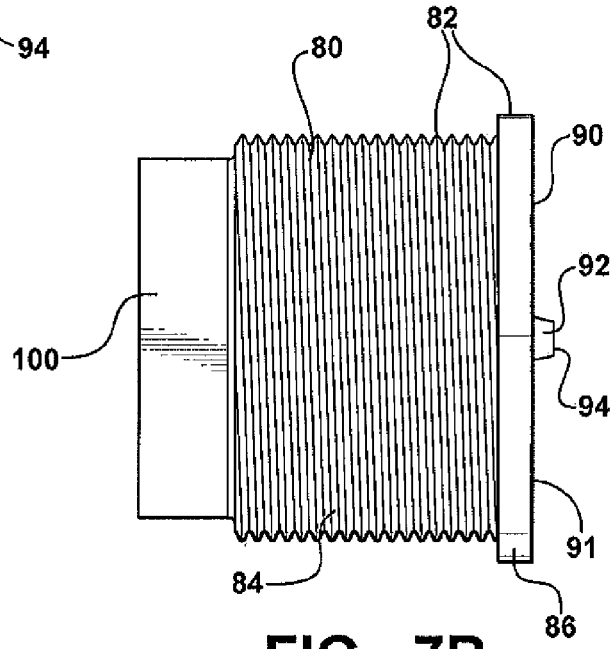
FIG. 7B is a side view of the first embodiment of the screw lock.
Figure 7C:
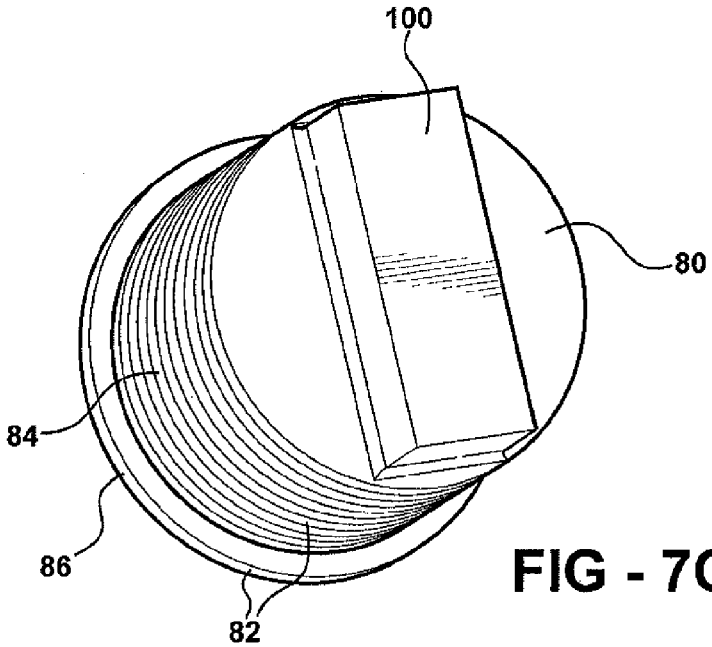
FIG. 7C is a rear perspective view of the first embodiment of the screw lock.
Figure 8A:
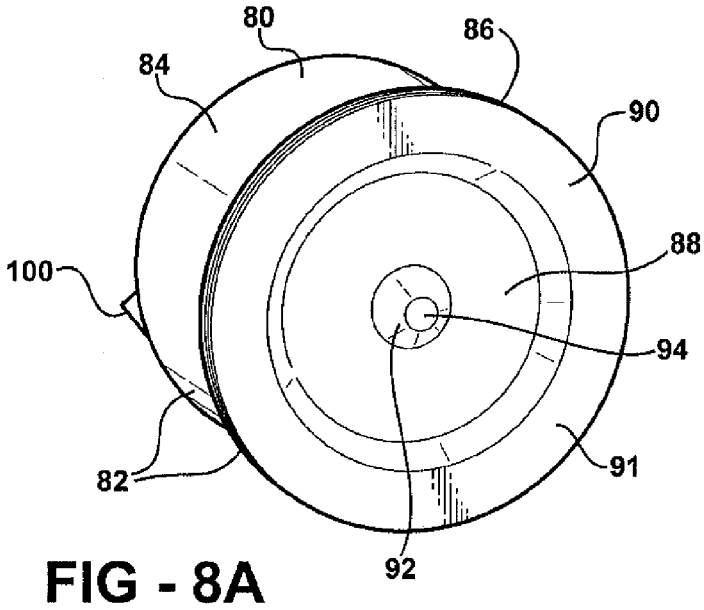
FIG. 8A is a front perspective view of a second embodiment of the screw lock.
Figure 8B:
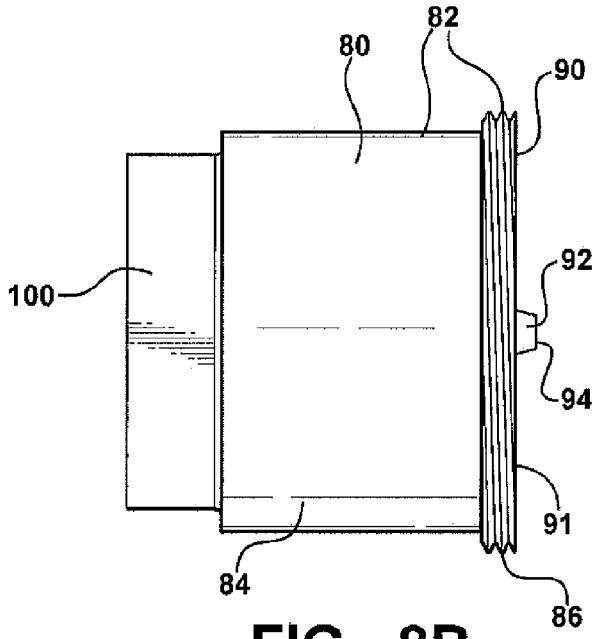
FIG. 8B is a side view of the second embodiment of the screw lock.
Figure 8C:
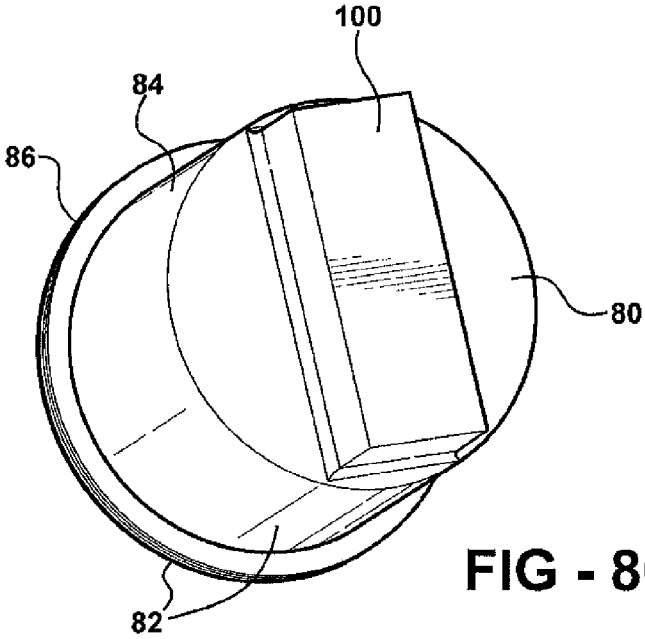
FIG. 8C is a rear perspective view of the second embodiment of the screw lock.

As shown in FIGS. 7A-10B, the screw lock 80 presents a cylindrical portion 82. More specifically the cylindrical portion 82 defines threads for threadingly engaging the threaded hole 78 of the elongated base 68. Preferably, the cylindrical portion 82 presents a shaft 84 and a flange 86. The elongated base 68 presents a ledge 102 and the flange 86 abuts the ledge 102 to maintain the screw lock 80 in the threaded hole 78. Specifically, as shown in FIG. 5, the screw lock 80 is inserted into the threaded hole 78 from the back 76 of the elongated base 68. When the elongated base 68 is slideably engaged within the astragal 44, the flange 86 in engagement with the ledge 102 prevents the screw lock 80 from being removed from the threaded hole 78. As shown in FIGS. 7A-C, the shaft 84 may define the threads for threadingly engaging the threaded hole 78. Alternatively, as shown in FIGS. 8A-10B, the shaft 84 may define the threads for threadingly engaging the threaded hole 78. The threaded hole 78 of the elongated base 68 defines threads corresponding to the threads defined by the cylindrical portion 82.

The screw lock 80 is rotatable between an unlocked position and a locked position to lock the elongated base 68 within the astragal 44. In the locked position, the screw lock 80 is engaged with the wall 50 of the astragal 44 to lock the elongated base 68 within the astragal 44 such that the slide bolt assembly 66 may not slide within the astragal 44. In the unlocked position, the screw lock 80 is disengaged with the wall 50 of the astragal 44 such that the elongated base 68 may slide within the astragal 44. For example, with the slide bolt assembly 66 in the retracted position, the screw lock 80 may be rotated to the locked position to prevent the slide bolt assembly 66 from sliding within the astragal 44, or in other words, to lock the slide bolt assembly 66 in the retracted position. In such a configuration, the semi-active door 36 is rotatable relative to the threshold 40. With the slide bolt assembly 66 in the retracted position and the screw lock 80 in the locked position, the semi-active door 36 may be rotated to the closed position. To prevent rotation of the semi-active door 36 relative to the threshold 40, the screw lock 80 may be unlocked and the slide bolt assembly 66 may be slid to the extended position to engage the bolt 72 with the underlying threshold 40. In such a configuration, the screw lock 80 may be rotated to the locked position such that the slide bolt assembly 66 may not slide within the astragal 44, or in other words, such that the slide bolt assembly 66 is locked in the extended position.

In the first embodiment of the screw lock 80, as shown in FIGS. 3A-B and FIGS. 7A-C, and in the second embodiment of the screw lock 80, as shown in FIGS. 8A-C, the screw lock

80 presents a central portion 88 and a rim portion 90 peripherally surrounding the central portion 88. The rim portion 90 presents a contact surface 91 being planar.

A nipple 92 protrudes from the central portion 88 of the screw lock 80. Preferably, the nipple 92 presents a tip 94 and the nipple 92 tapers inwardly from the central portion 88 to the tip 94. Preferably the nipple 92 is concentric with the central portion 88 of the screw lock 80. As shown in FIGS. 7B and 8B, the nipple 92 extends further from the screw lock 80 than the rim portion 90 for piercing a wall 50 of the astragal 44 when the screw lock 80 is rotated to the locked position.

Because the nipple 92 extends further from the central portion 88 than does the rim portion 90, when the screw lock 80 is rotated to the locked position the nipple 92 pierces the wall 50 of the astragal 44. The contact surface 91 of the rim portion 90 frictionally engages the wall 50 of the astragal 44 when the screw lock 80 is rotated to the locked position and the nipple 92 pierces the wall 50 of the astragal 44. For example, FIG. 3A, shows the screw lock 80 of the first embodiment in the unlocked position such that the nipple 92 is not piercing the wall 50 and the contact surface 91 is not frictionally engaging the wall 50. FIG. 3B shows the screw lock 80 of the first embodiment in the locked position such that both the nipple 92 is piercing the wall 50 of the astragal 44 and the contact surface 91 is frictionally engaging the wall 50 of the astragal 44. In other words, in the locked position, both the piercing of the wall 50 by the nipple 92 and the frictional engagement of the wall 50 by the rim portion 90, in conjunction, prevent the slide bolt 72 base from sliding within the astragal 44, or in other words, lock the slide bolt 72 base in position within the astragal 44. It is to be understood that the nipple 92, as disclosed in FIGS. 3A and 3B, is represented generically and could include the inward taper toward the tip 94 described above.

In the first and second embodiments, the screw lock 80 is formed from a first material having a first hardness and the astragal 44 is formed from a second material having a second hardness. Because the nipple 92 pierces the wall 50 of the astragal 44 in the locked position, preferably first hardness is greater than the second hardness. In other words, the screw lock 80 has a greater resistance to surface deformation than does the wall 50. Specifically, the first material is rigid and is preferably metal and more preferably steel. The second material is rigid and is preferably metal and more preferably aluminum. More specifically, for example, the first hardness of the steel is greater than 100 HB and less than 500 HB and the second hardness of the aluminum is greater than 15 HB and less than 100 HB The third embodiment of the screw lock 80, as shown in FIGS. 9A-B, and the fourth embodiment of the screw lock 80, as shown in FIGS. 10A-B, do not include the nipple 92 but rather include a friction pad 96. In the locked position, the friction pad 96 frictionally engages the wall 50 of the astragal 44 to prevent the slide bolt 72 base from sliding within the astragal 44. The friction pad 96 is preferably rubber. Alternatively, the friction pad 96 may be serrated metal, plastic, nylon, or any material that enhances the friction between the rim portion 90 and the wall 50. In the third and fourth embodiments of the screw lock 80, the screw lock 80 is preferably plastic but may be any rigid material such as metal, nylon, or the like.

Specifically, the third embodiment of the screw lock 80 also includes the rim portion 90 and the friction pad 96 is disposed on the rim portion 90. Alternatively, the third embodiment of the screw lock 80 does not include the friction pad 96 but instead the rim portion 90 defines serrations or other textures that enhance the friction between the screw lock 80 and the wall 50.

Specifically, in the fourth embodiment of the screw lock 80, the screw lock 80 does not include the rim portion 90, but rather presents a flat surface 98 and the friction pad 96 is disposed on the flat surface 98. Alternatively, the fourth embodiment of the screw lock 80 does not include the friction pad 96 but instead the flat surface 98 defines serrations or other textures that enhance the friction between the screw lock 80 and the wall 50.

The screw lock 80 presents a handle 100 extending from the screw lock 80 for manipulating the screw lock 80 in the threaded hole 78 between the unlocked position and the locked position. The handle 100 may be integral with or an attachment to the screw lock 80.

The screw lock 80 is disposed within the threaded hole 78 such that when the slide bolt assembly 66 is disposed in the astragal 44, the central portion 88 and the rim portion 90 of the first and second embodiments of the screw lock 80, and the friction pad 96 of the third and fourth embodiments of the screw lock 80, are unilateral with the back 76 of the elongated base 68. The handle 100 of the screw lock 80 is unilateral with the face 74 of the elongated base 68. In other words, the central portion 88 and the rim portion 90 of the first and second embodiments of the screw lock 80, and the friction pad 96 of the third and fourth embodiments of the screw lock 80 face the same direction as the back 76 of the elongated base 68. Therefore, the central portion 88 and the rim portion 90 of the first and second embodiments of the screw lock 80, and the friction pad 96 of the third and fourth embodiments of the screw lock 80 face the wall 50 of the astragal 44 when the slide bolt assembly 66 is disposed within the astragal 44. Likewise, the handle 100 faces 74 the same direction as the front of the elongated base 68. Therefore, the handle 100 faces 74 the opening of the astragal 44 such that the handle 100 may be manipulated through the opening of the astragal 44.

The invention has been described in an illustrative manner, and it is to be understood that the terminology which has been used is intended to be in the nature of words of description rather than of limitation. Obviously, many modifications and variations of the present invention are possible in light of the above teachings, and the invention may be practiced otherwise than as specifically described.

The invention claimed is:

1. A slide bolt assembly for sliding between a retracted position and an extended position within an astragal disposed at a free end of a semi-active door in a double-door set to releasably lock the semi-active door in a closed position, said slide bolt assembly comprising:

an elongated base having an end for a bolt to extend therefrom, said elongated base extending along an axis for slideably engaging the astragal generally parallel with said axis between the retracted position and the extended position;

said elongated base defining a threaded hole extending generally perpendicular to said axis;

a screw lock presenting a central portion and a rim portion extending from and peripherally surrounding said central portion, said screw lock threadingly engaging said threaded hole of said elongated base for rotation between an unlocked position and a locked position to lock said elongated base within the astragal; and a nipple protruding from said central portion of said screw lock in a common direction with said rim portion and extending from said central portion further than said rim portion for piercing a wall of the astragal when said screw lock is rotated to the locked position to prevent sliding of said slide bolt assembly within said astragal;

wherein said screw lock presents a handle extending from said screw lock for manipulating said screw lock in said threaded hole between the unlocked position and the locked position;

wherein said elongated base presents a face for disposition facing an opening of said astragal and a back opposite said face for disposition facing the wall of the astragal;

wherein said threaded hole of said elongated base is defined through said back and said face of said elongated base;

wherein said central portion and said rim portion of said screw lock and said back of said elongated base face a common direction, and said handle of said screw lock and said face of said elongated base face a common direction.

2. A slide bolt assembly as set forth in claim 1 wherein said nipple presents a tip and said nipple tapers inwardly from said central portion to said tip.

3. A slide bolt assembly as set forth in claim 1 wherein said nipple is concentric with said central portion of said screw lock.

4. A slide bolt assembly as set forth in claim 1 wherein said rim portion presents a contact surface for frictionally engaging the wall of the astragal when said screw lock is rotated to the locked position and said nipple pierces the wall of the astragal.

5. A slide bolt assembly as set forth in claim 4 wherein said contact surface is planar.

6. A slide bolt assembly as set forth in claim 1 wherein said screw lock is formed from a first material having a first hardness greater than the wall of the astragal.

7. A slide bolt assembly as set forth in claim 6 wherein said first material is steel.

8. A slide bolt assembly as set forth in claim 7 wherein said first hardness of said steel is greater than 100 HB and less than 500 HB.

9. A slide bolt assembly as set forth in claim 1 wherein said screw lock presents a cylindrical portion defining threads for threadingly engaging said threaded hole of said elongated base.

10. A slide bolt assembly as set forth in claim 1 further comprising a bolt extending from said elongated base generally parallel with said axis for engaging an underlying threshold when said slide bolt assembly is slid along the astragal to the extended position.

11. A slide bolt assembly as set forth in claim 1 wherein said elongated base presents a pair of lateral rails opposed and extending generally parallel with said axis for slideably engaging the wall of the astragal to slide said slide bolt assembly within the astragal between the retracted position and the extended position.

12. An astragal assembly for disposition on a free end of a semi-active door in a double-door set, said astragal assembly comprising:

an astragal presenting a wall;

a slide bolt assembly including an elongated base having an end for a bolt to extend therefrom, said elongated base extending along an axis and slideably engaged with said wall of said astragal for sliding along said astragal generally parallel with said axis between a retracted position and an extended position;

said elongated base defining a threaded hole extending generally perpendicular to said axis;

a screw lock presenting a central portion and a rim portion extending from and peripherally surrounding said central portion, said screw lock threadingly engaging said threaded hole of said elongated base and being rotatable between an unlocked position and a locked position for locking said elongated base within said astragal; and a nipple protruding from said central portion of said screw lock in a common direction with said rim portion and extending further from said central portion than said rim portion for piercing said wall of said astragal in said locked position to prevent sliding of said slide bolt assembly within said astragal;

wherein said rim portion presents a contact surface frictionally engaging said wall of said astragal simultaneously with said nipple piercing said wall of said astragal in said locked position.

13. An astragal assembly as set forth in claim 12 wherein said nipple presents a tip and said nipple tapers inwardly from said central portion to said tip.

14. An astragal assembly as set forth in claim 12 wherein said nipple is concentric with said central portion of said screw lock.

15. An astragal assembly as set forth in claim 12 wherein said screw lock is formed from a first material having a first hardness and said astragal is formed from a second material having a second hardness and said first hardness is greater than said second hardness.

16. An astragal assembly as set forth in claim 15 wherein said first material is steel and said second material is aluminum.

17. An astragal assembly as set forth in claim 16 wherein said first hardness of said steel is greater than 100 HB and less than 500 HB and said second hardness of said aluminum is greater than 15 HB and less than 100 HB.

18. A slide bolt assembly as set forth in claim 12 wherein said contact surface is planar.

19. An astragal assembly as set forth in claim 12 wherein said screw lock presents a cylindrical portion defining threads for threadingly engaging said threaded hole of said elongated base.

20. An astragal assembly as set forth in claim 12 further comprising a bolt extending from said elongated base generally parallel with said axis for engaging an underlying threshold when said slide bolt assembly is slid along the astragal to the extended position.

21. An astragal assembly as set forth in claim 12 wherein said elongated base presents a pair of lateral rails opposed and extending generally parallel with said axis for slideably engaging the wall of the astragal to slide said slide bolt assembly within the astragal between the retracted position and the extended position.

22. An astragal assembly as set forth in claim 12 wherein said screw lock presents a handle extending from said screw lock for manipulating said screw lock in said threaded hole between the unlocked position and the locked position.

23. An astragal assembly as set forth in claim 22 wherein said elongated base presents a face for disposition facing an opening of the astragal and a back opposite said face for disposition facing the wall of the astragal.

24. An astragal assembly as set forth in claim 23 wherein said threaded hole of said elongated base is defined through said back and said face of said elongated base.

25. An astragal assembly as set forth in claim 24 wherein said central portion and said rim portion of said screw lock and said back of said elongated base face a common direction, and said handle of said screw lock and said face of said elongated base face a common direction.

26. An astragal assembly as set forth in claim 12 wherein said elongated base presents a face for disposition facing an opening of the astragal and a back opposite said face for disposition facing the wall of the astragal with said threaded hole defined through said back and said face of said elongated base wherein said rim portion and said nipple of said screw lock and said back of said elongated base face a common direction.

27. A slide bolt assembly for sliding between a retracted position and an extended position within an astragal disposed at a free end of a semi-active door in a double-door set to releasably lock the semi-active door in a closed position, said slide bolt assembly comprising:

an elongated base having an end for a bolt to extend therefrom, said elongated base extending along an axis for slideably engaging the astragal generally parallel with said axis between the retracted position and the extended position;

said elongated base defining a threaded hole extending generally perpendicular to said axis;

a screw lock presenting a central portion and a rim portion extending from and peripherally surrounding said central portion, said screw lock threadingly engaging said threaded hole of said elongated base for rotation between an unlocked position and a locked position to lock said elongated base within the astragal; and a nipple protruding from said central portion of said screw lock in a common direction with said rim portion and extending from said central portion further than said rim portion, said nipple being configured to pierce a wall of the astragal when said screw lock is rotated to the locked position to prevent sliding of said slide bolt assembly within said astragal;

wherein said rim portion presents a contact surface configured to frictionally engage the wall of the astragal simultaneously with said nipple piercing the wall of the astragal in said locked position.

28. A slide bolt assembly as set forth in claim 27 wherein said nipple is concentric with said central portion of said screw lock.

29. A slide bolt assembly as set forth in claim 27 wherein said screw lock presents a cylindrical portion defining threads for threadingly engaging said threaded hole of said elongated base.

30. A slide bolt assembly as set forth in claim 27 wherein said elongated base presents a face for disposition facing an opening of the astragal and a back opposite said face for disposition facing the wall of the astragal, said threaded hole of said elongated base being defined through said back and said face of said elongated base.

31. A slide bolt assembly as set forth in claim 30 wherein said central portion has a surface and wherein said surface of said central portion, said contact surface of said rim portion, and said back of said elongated base face a common direction.

32. A slide bolt assembly as set forth in claim 31 wherein said screw lock presents a handle extending from said screw lock for manipulating said screw lock in said threaded hole between the unlocked position and the locked position and wherein said handle and said face of said elongated base face another direction different than said common direction of said surface of said central portion, said contact surface of said rim portion, and said back of said elongated base.

* * * * *